United States Patent [19]

Koshio et al.

[11] Patent Number: 4,500,002

[45] Date of Patent: Feb. 19, 1985

[54] APPARATUS FOR SORTING AND COUNTING A NUMBER OF BANKNOTES

[75] Inventors: Yoshihiro Koshio, Odawara; Tadao Kato, Ninomiya; Hikaru Kawano, Odawara, all of Japan

[73] Assignees: Musashi Co., Ltd., Tokyo; Hitachi Engineering Kabushiki Kaisha, Kanagawa, both of Japan

[21] Appl. No.: 450,194

[22] Filed: Dec. 16, 1982

[30] Foreign Application Priority Data

Dec. 21, 1981 [JP] Japan ..... 56-205140

[51] Int. Cl.[3] ..... B07C 5/08

[52] U.S. Cl. ..... 209/534; 209/541; 271/66; 271/186; 271/187; 271/303; 271/315

[58] Field of Search ..... 209/534, 540–542, 209/545, 551, 934; 235/379; 271/178, 184–187, 65, 315, 303, 66

[56] References Cited

U.S. PATENT DOCUMENTS 4,326,636 4/1982 Kawakami ..... 209/541

4,334,619 6/1982 Horino et al. ..... 209/534

FOREIGN PATENT DOCUMENTS 51598 4/1979 Japan ..... 209/534

*Primary Examiner*—Robert B. Reeves
*Assistant Examiner*—Donald T. Hajec
*Attorney, Agent, or Firm*—Brooks Haidt Haffner & Delahunty

[57] ABSTRACT

A paper currency sorting and counting apparatus comprises a first separating unit adapted for separating damaged notes and sound notes supplied through a judgement unit designed to judge the authenticity as well as damaged the state of supplied banknotes of various nominal values, a stacker for stacking reject notes, a second separating unit for sensing the front and reverse sides of the normal notes and controlling the route of these normal banknotes, and a stacker for normal notes having a pair of vane wheels for stacking the normal banknotes in order to provide for automatic sorting of the supplied banknotes.

3 Claims, 2 Drawing Figures

APPARATUS FOR SORTING AND COUNTING A NUMBER OF BANKNOTES

BACKGROUND AND SUMMARY OF THE INVENTION

This invention relates to a novel construction of an apparatus for sorting and counting a number of supplied banknotes.

So far, the operation of sorting and counting the number of supplied banknotes according to different nominal values, placing them in a unified direction, and rejecting damaged notes required manual operations and, hence, considerable time and expense.

The present invention contemplates to providing an apparatus for sorting and counting the number of supplied banknotes which is fully effective to obviate the above drawbacks. Thus, the apparatus comprises a first separating unit adapted for separating damaged and proper notes supplied through a judgement unit designed to judge the authenticity as well as damaged state of the supplied banknotes of various nominal values, a stacker for heaping reject notes, a second separating unit for sensing the front side and reverse side of the normal banknotes and controlling the route of these normal banknotes, and a stacker for normal banknotes having a pair of vane wheels for stacking the normal banknotes, in order to provide for automatic sorting of the supplied banknotes. According to one aspect of the present invention, the sorting and counting apparatus has the function of computing and printing out the sum of the values of the banknotes.

DESCRIPTION OF THE DRAWINGS

This invention will become more readily apparent from the following description of a preferred embodiment thereof shown, by way of an example only, in the acccompanying drawings in which.

DESCRIPTION OF THE PREFERRED EMBODIMENT

Figure 1:
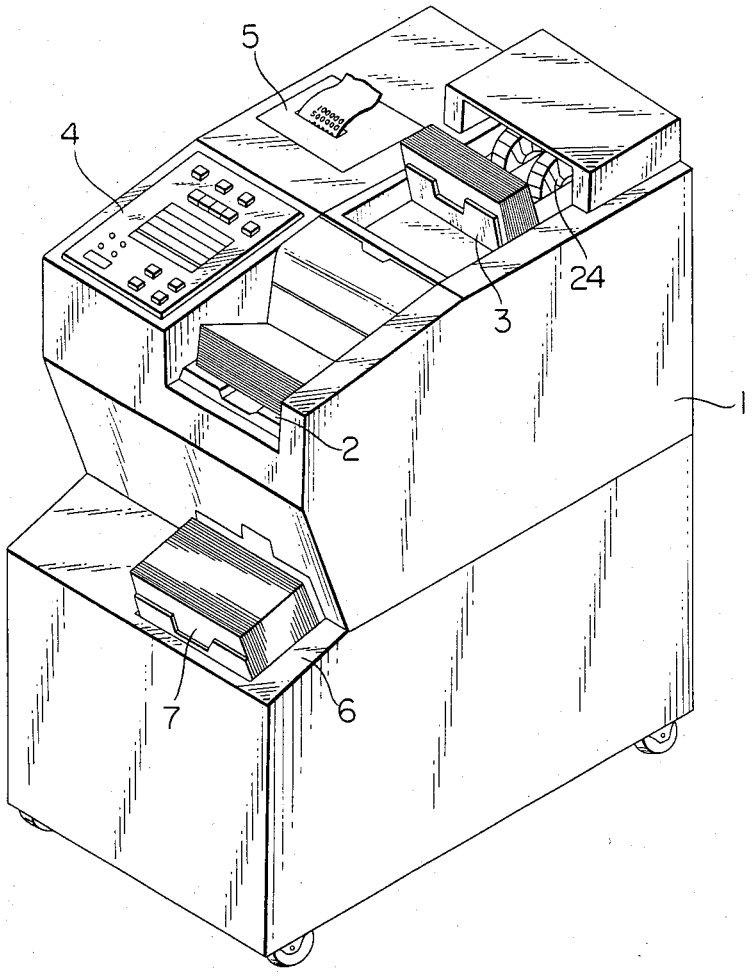
FIG. 1 illustrates the sorting and counting apparatus in perspective.

FIG. 1 illustrates a sorting and counting apparatus for banknotes according to the present invention. A hopper 2 for receiving banknotes of various nominal values is provided on the front side of a main casing member 1, and a stacker 3 for rejected banknotes is provided in back of the hopper 2.

A display/operating panel 4 having an operating panel and a printer 5 are also provided on the upper surface of the main casing member 1 for indicating and printing out sum totals or subtotals according to respective nominal values. A stacker 7 for normal or accepted banknotes is provided on a stepped part 6 of the main casing member 1.

Figure 2:
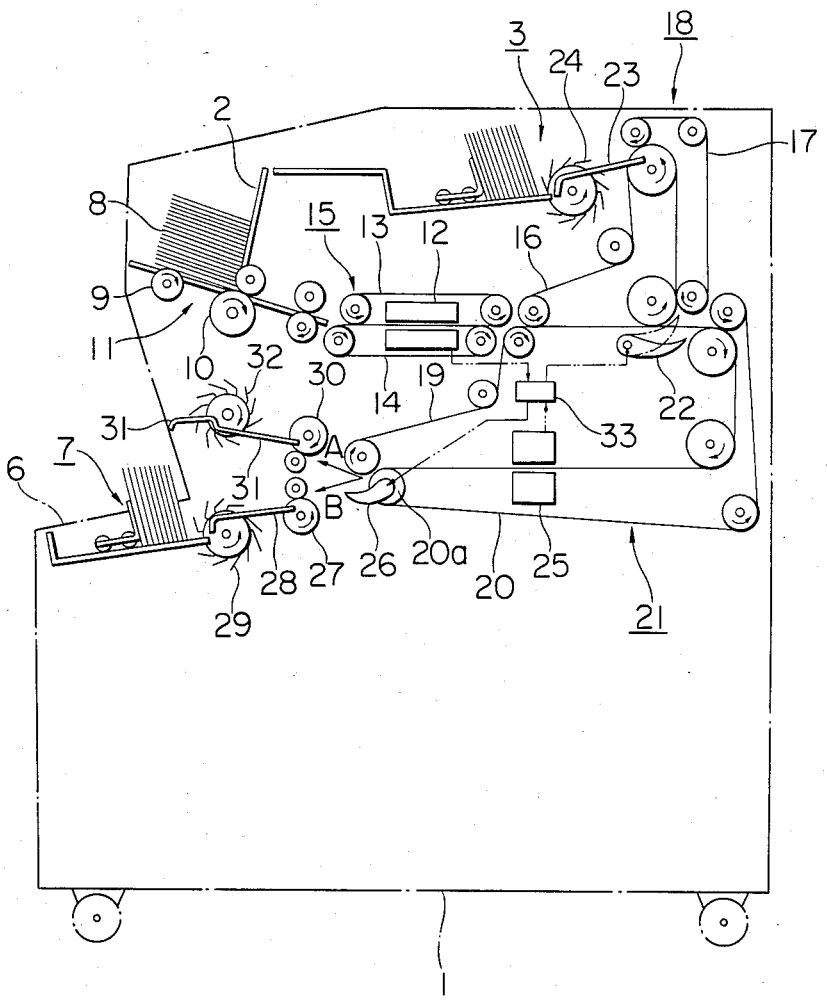
FIG. 2 is a diagrammatic view showing the inside structure of the sorting and counting apparatus illustrated in FIG. 1.

FIG. 2 illustrates the inside structure of the sorting and counting device for banknotes shown in FIG. 1. The banknotes 8 of various nominal values stacked in the hopper 2 are fed out one by one by a feed-in roll 9 provided on the lower part of the hopper 2 and a feed-out roll 10 spaced apart a suitable distance from the feed-in roll 9.

The feed-in roll 9 and the feed-out roll 10 make up a feed-out unit 11. Since the feed-out roll 10 has a peripheral length larger than the length of the short side of the banknote 8, the latter may be fed out with fixed intervals between one another upon continued rotation of the feed-out roll 10.

The banknotes 8 fed out from the unit 11 are supplied to a first transfer unit 15 having a judgement unit 12 known per se and a pair of supply belts 13, 14. The unit 12 gives judgement as to the nominal values, whether the note is authentic or false and whether the banknote is in the damaged state or in the sound state. Various output signals from the judgement unit 12 are supplied to a control unit 33. The banknotes 8 supplied from the first transfer unit 15 are further transferred to the subsequent step by a second transfer unit comprised of a pair of supply belts 16, 17 and a third transfer unit 21 comprised of a pair of supply belts 19, 20. A first branch unit comprised of at least one first branch guide 22 is mounted below the supply belt 19 of the third transfer unit 21 and adapted to rotate between the solid-line and chain dotted line positions in FIG. 2 upon energization of a solenoid, not shown. This first branch guide 22 is normally positioned as indicated by the solid line in FIG. 1. However, when the unit 12 has issued a reject signal, that is, the signal indicating damaged or false banknotes, the branch guide 12 is turned to the chain-dotted line position owing to the solenoid energization so that only rejected banknotes 8 supplied from the feed-in unit 11 and the first transfer unit 15 is transferred to the reject note stacker 3 through the guide plate 23 and a vane wheel 24 which is known per se.

The normal banknotes not branched by the first branch unit 22 are supplied to the third transfer unit 21 and checked as to the front and reverse sides by a front-reverse side checker 25 which is also known per se. Output signals from this checker 25 are supplied through the control unit 33 to a solenoid, not shown, which is associated with a second branch unit comprised of at least one second branch guide 26 coaxially mounted in turn on a feed roll 20*a* of the feed belt 20. The second branch guide 26 is turned in the direction of the arrow mark B or A depending on whether the banknotes 8 have been supplied through the third transfer unit 21 with their front sides facing upwards or downwards, respectively. Thus, in the event of the normal banknotes being supplied with the front sides facing upwards, the second branch guide 26 is brought to the position indicated by the arrow mark B and the banknotes 8 are stacked in a normal banknote stacker 7 through a lower feed roll 27, guide plate 28 and a vane 29 associated with the stacker 7. In the event of the normal banknotes 8 being supplied with their reverse sides facing upwards, the second branch guide 26 is brought to the position indicated by the arrow mark A and the banknotes 8 are supplied through an upper supply roll 30, a guide plate 31 and a vane wheel 32 mounted on top of said normal note stacker 7, said vane wheel 32 having implanted vanes extending in the reverse direction to that of the vanes of the vane wheel 29 and also rotating in the reverse direction to that of the vane wheel 29. The banknotes thus transferred are ultimately stacked in the normal note stacker 7 through the end of the guide plate 31 with their front sides facing in the proceeding direction.

In the operation of the banknote sorting and counting device, banknotes of different nominal values are supplied into the stacker 2 and the display/operating panel 4 is operated for specifying a desired one of the counting mode (the mode of indicating and printing a sum-total and sub-totals according to the different face values of the charged banknotes), specified mode (the mode of taking out only banknotes of a specified nominal value from the charged banknotes of different nominal values, counting their number and placing them with their forward or reverse sides facing in the unified directions) and damaged reject mode (the mode of sorting into damaged and sound banknotes, counting the number of the sound banknotes and placing them with their front and reverse sides in the same directions. The unit 12 gives a judgement as to whether the banknote 8 is authentic and the notes judged to be authentic are supplied to the third transfer unit 21 whereas reject banknotes such as damaged notes are stacked in the reject note stacker 3 through the second transfer unit 18 and the vane wheel 24 by operation of the first branch unit 22.

The normal banknotes supplied to the third transfer unit 21 through the first branch unit 22 arrive at the second branch guide 26 where the banknotes having their front sides facing upwards are supplied through the lower feed roll 27 and the vane wheel 29 to be stacked in the normal note stacker 7, while the banknotes having their reverse sides facing upwards are supplied through the upper feed roll 30 and the vane wheel 32 through the lower surface of the guide plate 31 and stacked in the normal banknote stacker 7 in the same status as the notes supplied through the lower roll 27. Therefore, the notes are stacked in the stacker 7 with their front or reverse sides facing in the same directions.

The status of the normal banknotes stacked in the normal note stacker 7 is displayed on the panel 4 and printed out in the printer 5 depending on which mode has been designated on the display/operating panel 4.

In the construction and the operation of the banknote sorting and counting apparatus, described and illustrated hereinabove, the banknotes of a variety of nominal values can be checked as to their authenticity and number and as to whether the banknotes are being transferred with their right sides upwards and only the normal banknotes can be placed in the stacker in an aligned state and with their front sides in the same direction. Therefore, the apparatus is extremely useful in promoting the money receiving operation in the bank and capable of reducing the time necessary for sorting and/or counting the number of the banknotes of different nominal values.

What is claimed is:

1. An apparatus for sorting and counting a number of banknotes comprising;

a hopper for stacking the banknotes;

a feed-out unit for taking out the banknotes one by one from said hopper;

a judgement unit for identifying those banknotes in a damaged state and for judging the authenticity of the banknotes coming in from said feed-out unit;

a first branch unit for selecting the route to be followed by the banknotes from said judgement unit depending on the signals from said judgement unit;

a reject note stacker having a first vane wheel and adapted for stacking reject banknotes supplied through a first route specified by said first branch unit;

a front-reverse side checker for sensing the front and reverse sides of the banknotes supplied through a second route specified by said first branch unit;

a second branch unit for alternately selecting between two routes for the banknotes which have passed through said front-reverse side checker on the basis of respective front side and reverse side signals from said front-reverse side checker; and a single, normal banknote stacker having a pair of vane wheels each provided in the respective of said two routes for banknotes that have passed through said front-reverse side checker, said vane wheels rotating in mutually opposite directions for stacking the notes from said second branch unit in said normal banknote stacker with their same sides facing in the same directions therein.

2. The apparatus as claimed in claim 1, wherein said first branch unit comprises at least one guide member for rotating alternately between a reject note route side and a normal note route side based on respective reject note and normal note signals received from said judgement unit.

3. The apparatus as claimed in claim 2, wherein said second branch unit comprises at least one guide member for rotating alternately between a front side note route side and a reverse side note route side based on respective front side note and reverse side note signals received from said front-reverse side checker.

* * * * *

UNITED STATES PATENT AND TRADEMARK OFFICE

CERTIFICATE OF CORRECTION

PATENT NO. : 4,500,002

DATED : February 19, 1985

INVENTOR(S) : YOSHIHIRO KOSHIO et al

It is certified that error appears in the above-identified patent and that said Letters Patent is hereby corrected as shown below:

On the title page;

[73] Assignees: should read --Musashi Co., Ltd., Tokyo; Hitachi Denshi Engineering Kabushiki Kaisha, Kanagawa, both of Japan--

Abstract, line 4, "as well as" should read --as well as the--.

Abstract, line 5, "damaged the state" should read --damaged state--.

Column 1, line 15, "contemplates to providing" should read --contemplates providing--.

Colunm 1, line 38, "drawings in which:" should read --drawings, in which:--.

Signed and Sealed this

*Fifteenth* Day of *October 1985*

[SEAL]

*Attest:*

*Attesting Officer*

DONALD J. QUIGG

*Commissioner of Patents and Trademarks—Designate*